US010042290B2

(12) United States Patent
Maeyama

(10) Patent No.: US 10,042,290 B2
(45) Date of Patent: Aug. 7, 2018

(54) IMAGE FORMING APPARATUS AND IMAGE FORMING METHOD FOR CLEANING THE INTERMEDIATE TRANSFER BELT

(71) Applicant: Konica Minolta, Inc., Chiyoda-ku, Tokyo (JP)

(72) Inventor: Takeshi Maeyama, Ikeda (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/436,896

(22) Filed: Feb. 20, 2017

(65) Prior Publication Data

US 2017/0248873 A1 Aug. 31, 2017

(30) Foreign Application Priority Data

Feb. 26, 2016 (JP) ..... 2016-035278

(51) Int. Cl.
*G03G 15/16* (2006.01)

(52) U.S. Cl.
CPC ..... *G03G 15/161* (2013.01)

(58) Field of Classification Search
CPC ..... G03G 15/161
USPC ..... 399/101
See application file for complete search history.

(56) References Cited

U.S. PATENT DOCUMENTS 6,029,025 A * 2/2000 Sakakibara ..... G03G 15/0105 399/299
7,817,933 B2 * 10/2010 Thayer ..... G03G 21/0029 399/123
2013/0089356 A1 * 4/2013 Yamaki ..... G03G 15/161 399/101

(Continued)

FOREIGN PATENT DOCUMENTS

JP 01167876 A * 7/1989
JP 05193772 A * 8/1993
JP 05313525 A * 11/1993

(Continued)

OTHER PUBLICATIONS

Tanaka et al., "Image Forming Apparatus", Jul. 2014, JP2014134620A, Machine English Translation by JPO, Detailed Description.*

*Primary Examiner* — Susan Lee
(74) *Attorney, Agent, or Firm* — Buchanan Ingersoll & Rooney PC

(57) ABSTRACT

An image forming apparatus includes an image carrier, a latent image forming device, a developer, an intermediate transfer belt, a second transfer device, a cleaner, an abutting angle adjuster and a hardware processor. The intermediate transfer belt supports and carries a toner image which is transferred from the image carrier by primary transfer. The second transfer device performs secondary transfer to transfer the toner image transferred on the intermediate transfer belt to a recording medium. The cleaner abuts the intermediate transfer belt to remove toner attached to a surface of (Continued)

the intermediate transfer belt. The abutting angle adjuster adjusts an abutting angle between the cleaner and the intermediate transfer belt. The hardware processor controls the abutting angle adjuster to maintain the abutting angle at a predetermined angle.

12 Claims, 9 Drawing Sheets

(56) References Cited

U.S. PATENT DOCUMENTS

2015/0338785 A1* 11/2015 Ai ..... G03G 15/161
399/101

FOREIGN PATENT DOCUMENTS

| | | | | |
|---|---|---|---|---|
| JP | 2008-003123 | A | | 1/2008 |
| JP | 2010197611 | A | * | 9/2010 |
| JP | 2012145846 | A | * | 8/2012 |
| JP | 2014-134620 | A | | 7/2014 |
| JP | 2015194627 | A | * | 11/2015 |

* cited by examiner

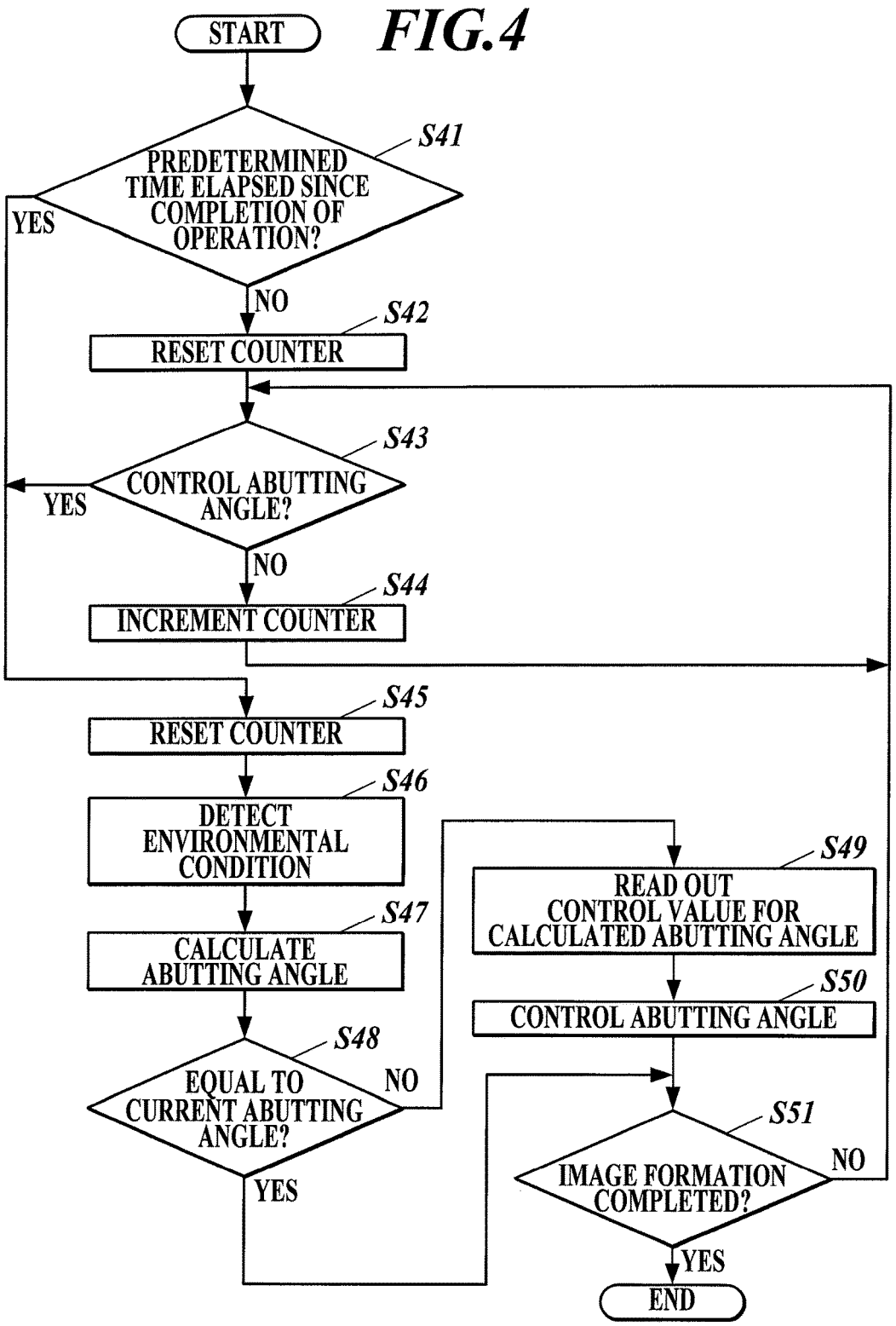
FIG.4
START
S41
PREDETERMINED TIME ELAPSED SINCE COMPLETION OF OPERATION?
YES
NO
S42
RESET COUNTER
S43
CONTROL ABUTTING ANGLE?
YES
NO
S44
INCREMENT COUNTER
S45
RESET COUNTER
S46
DETECT ENVIRONMENTAL CONDITION
S47
CALCULATE ABUTTING ANGLE
S48
EQUAL TO CURRENT ABUTTING ANGLE?
NO
YES
S49
READ OUT CONTROL VALUE FOR CALCULATED ABUTTING ANGLE
S50
CONTROL ABUTTING ANGLE
S51
IMAGE FORMATION COMPLETED?
NO
YES
END

| SYMBOL | CHANGE OF ENVIRONMENT | NUMBER OF SHEETS PROCESSED BEFORE CHANGE OF ENVIRONMENT | EXAMPLE 1 (WITH CONTROL OF ABUTTING ANGLE) | COMPARISON 1 (WITHOUT CONTROL OF ABUTTING ANGLE) |
|---|---|---|---|---|
| A | HH→LL | 10000 SHEETS | ○ | × |
| B | HH→b | 10000 SHEETS | ○ | × |
| C | HH→NN | 10000 SHEETS | ○ | × |
| D | a→b | 10000 SHEETS | ○ | ○ |
| E | a→NN | 10000 SHEETS | ○ | ○ |

| SYMBOL | CHANGE OF ENVIRONMENT | NUMBER OF SHEETS PROCESSED BEFORE CHANGE OF ENVIRONMENT | EXAMPLE 2 (WITH CONTROL OF ABUTTING ANGLE) | COMPARISON 2 (WITHOUT CONTROL OF ABUTTING ANGLE) |
|---|---|---|---|---|
| A | HH→LL | 10000 SHEETS | ○ | × |
| B | HH→b | 10000 SHEETS | ○ | × |
| C | HH→NN | 10000 SHEETS | ○ | × |
| D | a→b | 10000 SHEETS | ○ | × |
| E | a→NN | 10000 SHEETS | ○ | × |

IMAGE FORMING APPARATUS AND IMAGE FORMING METHOD FOR CLEANING THE INTERMEDIATE TRANSFER BELT

BACKGROUND OF THE INVENTION

1. Field of the Invention

The present invention relates to an image forming apparatus and an image forming method.

2. Description of Related Art

To maintain the image quality of image forming apparatuses, foreign matter such as toner attached to the surface of an intermediate transfer belt has been removed by using a blade that abuts the intermediate transfer belt.

Since such a blade directly abuts the intermediate transfer belt, there is an image forming apparatus that maintains the cleaning performance at a high level by changing the abutting angle of the blade according to the environmental conditions of the image forming apparatus (e.g. the duration of cleaning, the printing mode such as color printing or monochrome printing or the like) (see JP 2014-134620A and JP 2008-003123A).

Since normal blades using a rubber material generate a large frictional force against the intermediate transfer belt, a method of reducing the frictional force against the intermediate transfer belt has been invented which uses a blade abutting member (hereinafter referred to as a rigid blade) having a portion to abut the intermediate transfer belt made of a non-elastic material such as metal that is less elastically deformable than rubber.

However, in such methods that uses a rigid blade for the portion to abut the intermediate transfer belt, the frictional force against the intermediate transfer belt increases in a high-temperature high-humidity environment. In such cases, the rigid blade is pushed in the rotational direction of the intermediate transfer belt by the action of the increased frictional force and thus moves or deforms in the direction of increasing the abutting angle. In contrast, the frictional force against the intermediate transfer belt decreases in a low-temperature low-humidity environment. In such cases, the rigid blade returns in the direction opposite the rotational direction of the intermediate transfer belt to balance the decreased frictional force and thus moves or deforms in the direction of decreasing the abutting angle.

When the environmental condition changes from a high-temperature high-humidity environment to a low-temperature low-humidity environment after the abutting portion of the rigid blade is worn out in a high-temperature and high-humidity environment (in a condition of a large abutting angle), a phenomenon (hereinafter referred to as edge separation) that the worn part is separated from the intermediate transfer belt occurs since the frictional force against the intermediate transfer belt decreases so that the rigid blade moves or deforms in the direction of decreasing the abutting angle.

When such edge separation occurs, toner penetrates into the gap between the intermediate transfer belt and the worn part and acts to lift up the rigid blade. As a result, the rigid blade cannot sufficiently remove foreign matter such as toner attached to the surface of the intermediate transfer belt, and the apparatus eventually cannot maintain the cleaning performance.

However, in the other methods in which the abutting portion elastically deforms, e.g. in cleaning methods using a rubber blade, since the rubber blades has a large coefficient of friction, an external additive that is dissociated from toner is held by the action of the frictional force against the rubber blade and forms an aggregation called a static layer on the upstream side of the abutting portion between the belt and the rubber blade. Therefore, even when a condition similar to edge separation is caused by a change of the environmental condition after a worn part is formed, the static layer of the external additive held at the part fills the gap and prevents the toner from penetrating into the gap between the intermediate transfer belt and the worn part in cooperation with elastic deformation of the rubber blade itself. Therefore, rubber blades do not have such a problem that rigid blades have.

However, the image forming apparatus described in JP 2014-134620A changes the abutting angle or the like according to the duration of abutting time of the blade with the intermediate transfer belt but does not control the abutting angle according to a change of the environmental condition. Therefore, when a rigid blade is employed, edge separation may occur. The image forming apparatus described in JP 2008-003123A is intended to use a rubber blade but is not intended to use a rigid blade in the first place.

Further, the image forming apparatus described in JP 2008-003123A is intended to cope with a change of the trajectory of the intermediate transfer belt between color printing and monochrome printing and does not control the abutting angle in response to a change of the environmental condition. Therefore, when a rigid blade is employed, edge separation may occur.

SUMMARY OF THE INVENTION

It is an object of the present invention to provide an image forming apparatus that does not cause edge separation and can maintain the cleaning performance.

In order to realize the above object, according to one aspect of the present invention, there is provided an image forming apparatus, including:

an image carrier;

a latent image forming device which forms a latent image on the image carrier;

a developer which develops the latent image on the image carrier by using a developing agent containing at least a toner;

an intermediate transfer belt which supports and carries a toner image which is transferred from the image carrier by primary transfer;

a second transfer device which performs secondary transfer to transfer the toner image transferred on the intermediate transfer belt to a recording medium;

a cleaner which abuts the intermediate transfer belt to remove toner attached to a surface of the intermediate transfer belt and which comprises an abutting portion that is less elastically deformable than rubber;

an abutting angle adjuster which adjusts an abutting angle between the cleaner and the intermediate transfer belt; and a hardware processor which controls the abutting angle adjuster to maintain the abutting angle at a predetermined angle.

Preferably, the image forming apparatus further includes an environment detector which detects a usage environment, wherein the hardware processor calculates the predetermined angle based on a detection result by the environment detector and which controls the abutting angle adjuster to adjust the abutting angle to the predetermined angle.

Preferably, the abutting portion of the cleaner is made of a metal material.

Preferably, the intermediate transfer belt is constituted by two or more layers at least one of which is made of an elastically deformable material.

Preferably, the abutting angle adjuster changes a pressing force applied to the cleaner by means of a cam.

Preferably, the abutting angle adjuster changes a biasing force applied to a blade holder of the cleaner by means of a driver or a magnetic force.

Preferably, the abutting angle adjuster changes a position of a counter roller or a guide roller provided on a back side of the intermediate transfer belt by means of a cam so as to change a trajectory of the intermediate transfer belt at an abutting portion between the cleaner and the intermediate transfer belt.

BRIEF DESCRIPTION OF THE DRAWINGS

The present invention will become more fully understood from the detailed description given hereinbelow and the appended drawings which are given by way of illustration only, and thus are not intended as a definition of the limits of the present invention, and wherein:

FIG. 4 is a flowchart of an example of the operation of the image forming apparatus;

DETAILED DESCRIPTION OF THE PREFERRED EMBODIMENT

Embodiment

1. Description of Configuration

Hereinafter, an image forming apparatus according to an embodiment of the present invention will be described based on the drawings.

Figure 1:
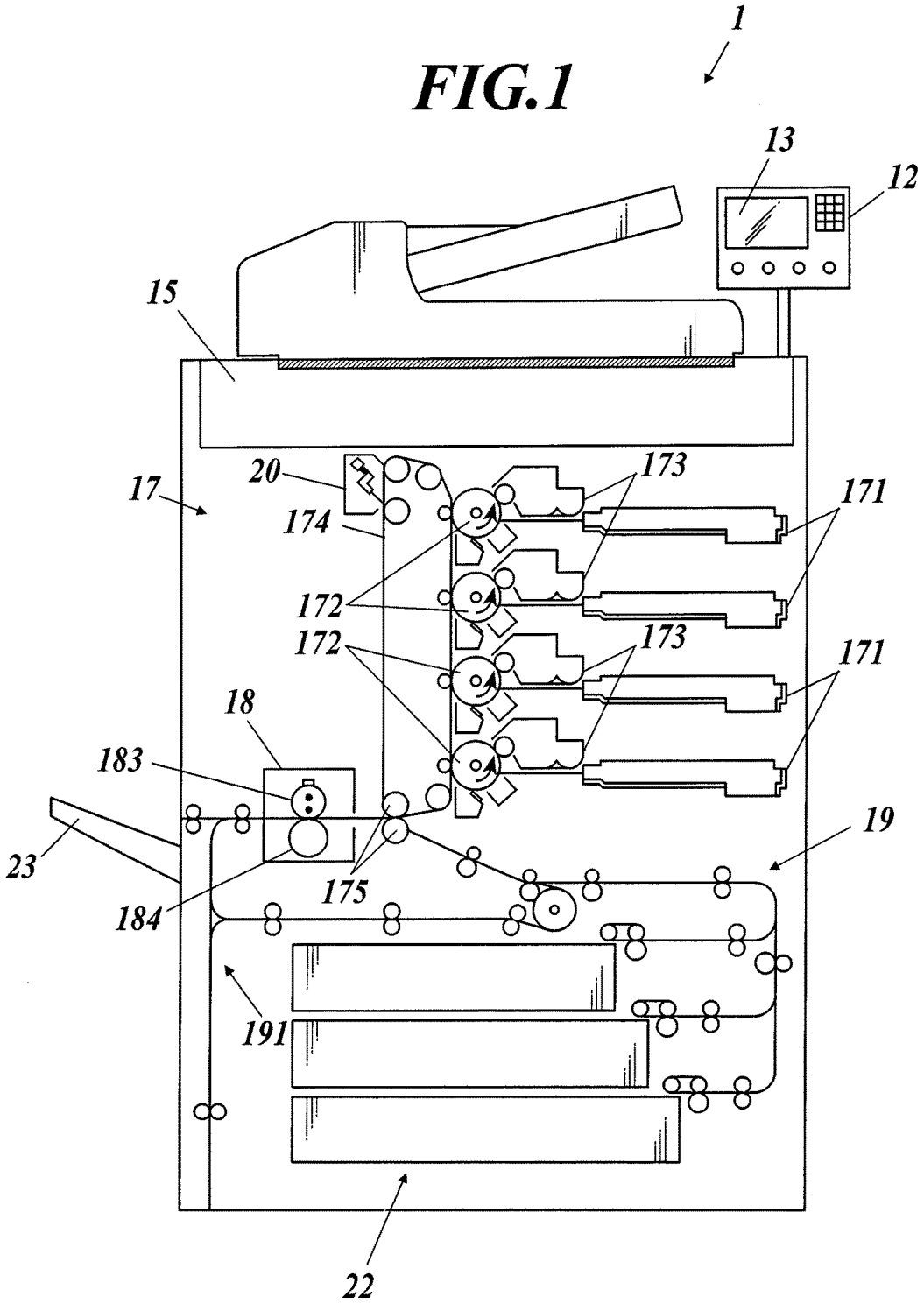
FIG. 1 illustrates the schematic configuration of an image forming apparatus according to an embodiment of the present invention.
Figure 2:
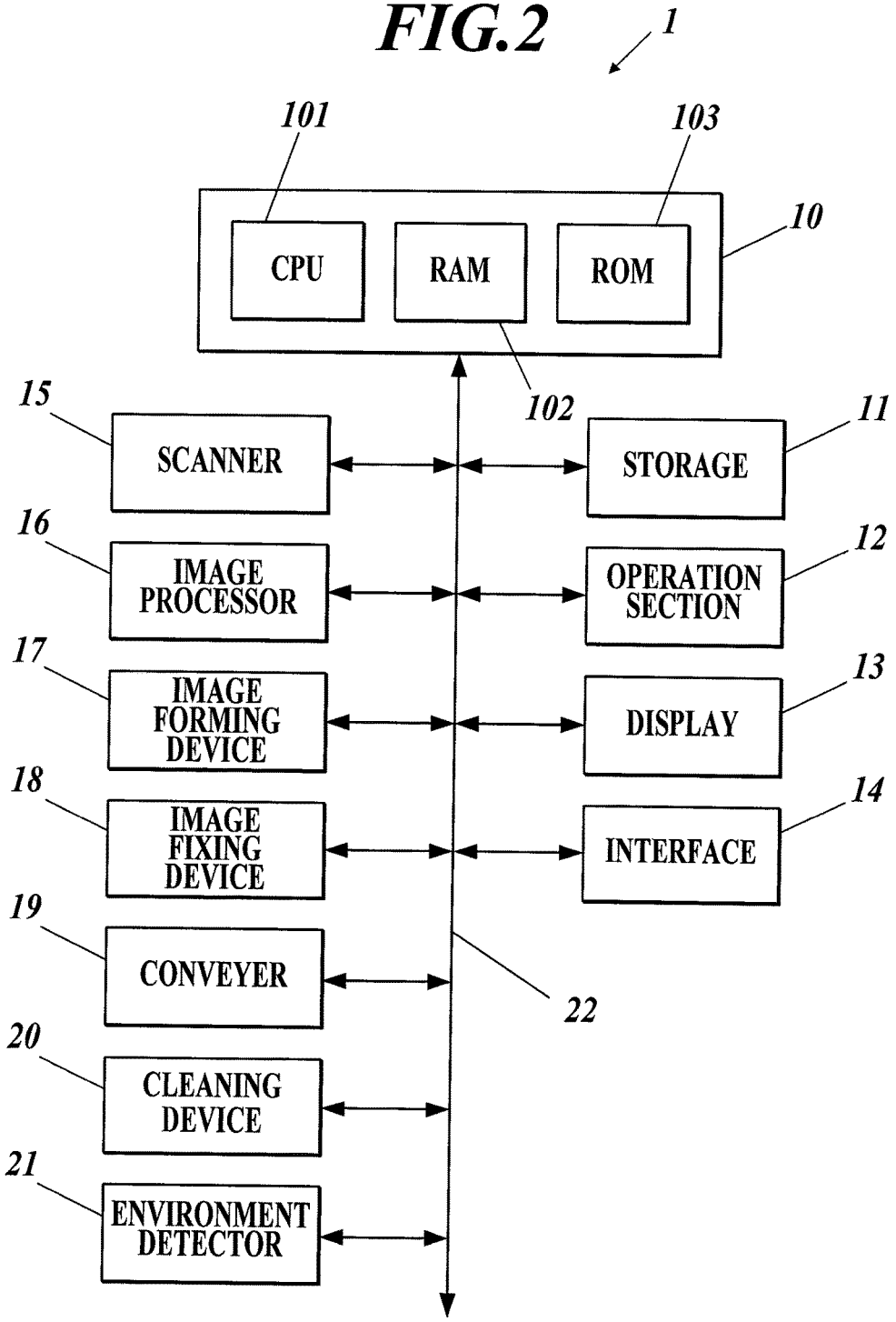
FIG. 2 is a block diagram of the main functional configuration of the image forming apparatus.

FIG. 1 is the schematic configuration of the image forming apparatus 1 according to the embodiment of the present invention. FIG. 2 is a block diagram of the main functional configuration of the image forming apparatus 1.

The image forming apparatus 1 includes a hardware processor 10 that includes a CPU 101 (central processing unit), a RAM 102 (random access memory) and a ROM 103 (read only memory), a storage 11, an operation section 12, a display 13, an interface 14, a scanner 15, an image processor 16, an image forming device 17, an image fixing device 18, a conveyer 19, a cleaning device 20, an environment detector 21 and the like. The hardware processor 10 is connected to the storage 11, the operation section 12, the display 13, the interface 14, the scanner 15, the image processor 16, the image forming device 17, the image fixing device 18, the conveyer 19, the cleaning device 20 and the environment detector 21 via a bus 22.

The CPU 101 reads out a control program stored in the ROM 103 or the storage 11 and executes it to perform a variety of processing.

The RAM 102 provides a working memory space to the CPU 101 and stores temporary data.

The ROM 103 stores a variety of control programs to be executed by the CPU 101, setting data and the like. In replace of the ROM 103, a rewritable non-volatile memory such as an EEPROM (electrically erasable programmable read only memory) or a flash memory may be used.

The hardware processor 10 that includes the above-described CPU 101, RAM 102 and ROM 103 integrally controls the components of the image forming apparatus 1 according to the above-described control programs. For example, the hardware processor 10 controls the image processor 16 to perform predetermined image processing on image data, and then stores it in the storage 11. Further, the hardware processor 10 controls the conveyer 19 to convey a sheet and also controls the image forming device 17 to form an image based on the image data stored in the storage 11.

The storage 11 is composed of a storing means such as a DRAM (dynamic random access memory), which is a semiconductor memory, and an HDD (hard disk drive). In the storage 11, image data obtained by the scanner 15, image data input from the outside via the interface 14 and the like are stored. Such image data and the like may be stored in the RAM 102 instead.

The operation section 12, which includes input devices such as operation keys and a touch panel overlaid on a screen of the display 13, converts an operation input on the input devices to an operation signal and outputs it to the hardware processor 10.

The display 13, which includes a display device such as an LCD (liquid crystal display), displays the status of the image forming apparatus 1, an operation screen that shows operations to be input on the touch panel and the like.

The interface 14 is configured to send and receive data to and from an external computer, another image forming apparatus and the like, which is constituted by, for example, a serial interface of any type.

The scanner 15 reads an image formed on a sheet and generates image data including individual monochromatic image data with respect to each of the color components of R (red), G (green) and B (blue) and stores it in the storage 11.

The image processor 16, which includes, for example, a rasterizing processor, a color converter, a gradation corrector and a halftone processor, performs a variety of image processing on image data stored in the storage 11 and stores it in the storage 11, The image forming device 17 forms an image on a sheet based on image data stored in the storage 11. The image forming device 17 includes four sets of an exposing unit 171, a photoreceptor drum 172 and a developing unit 173 respectively for the color components of C (cyan), M (magenta), Y (yellow) and K (black). The image forming device 17 further includes an intermediate transfer belt 174 and a secondary transfer roller 175. The intermediate transfer belt 174 is constituted by two or more layers that are not elastically deformable.

The exposing unit 171 includes an LD (laser diode) as a light emitting element. The exposing unit 171 drives the LD based on image data to irradiate the charged photoreceptor drums 172 with laser light to expose them, so as to form an electrostatic latent image on the photoreceptor drums 172. The developing units 173 supply toner (coloring material, any color of C, M, Y and K) onto the exposed photoreceptor drums 172 by means of charged developing rollers so as to develop the electrostatic latent images formed on the photoreceptor drums 172.

The images (monochromatic images) on the four photoreceptor drums 172 of C, M, Y and K formed by the respective toners of C, M, Y and K are transferred from the photoreceptor drums 172 and sequentially overlaid on the intermediate transfer belt 174. In this way, a color image that is composed of the color components of C, M, Y and K is formed on the intermediate transfer belt 174. The intermediate transfer belt 174, which is constituted by an endless belt supported by transfer body conveyance rollers, is driven according to the rotation of the transfer body conveyance rollers.

The secondary transfer roller 175 transfers the color image on the intermediate transfer belt 174 onto a sheet that is fed from a sheet feeding tray 22 or an external sheet feeding device. In more detail, a predetermined transfer voltage is applied to the sheet and the secondary transfer roller 175 that nips the intermediate transfer belt 174, and the toner of the color image on the intermediate transfer belt 174 is thereby drawn toward the sheet and thus transferred to the sheet.

The image fixing device 18 performs fixation that involves heating and pressing the sheet on which the toner has been transferred so as to fix the toner on the sheet.

The fixing roller 183 includes halogen lamp heaters each of which is constituted by a fixing lamp (or a fixing heater) extending along the rotating axis. The halogen lamp heaters generate heat by being energized under control of the hardware processor 10. The fixing roller 183 is rotated by a rotating means (not shown) such as a motor under control of the hardware processor 10. In the fixing roller 183, a temperature detector 185 is provided to detect the temperature of the fixing roller 183. The temperature detector 185 may be composed of either single temperature detector or two or more temperature detectors as long as it can detect the temperature of the fixing roller 183.

The pressing roller 184 is biased toward the fixing roller 183 by means of an elastic member (not shown) and is thereby in pressure contact with the fixing roller 183. The pressing roller 184 is rotated along with the rotation of the fixing roller 183, in which a fixing nip is formed between the fixing roller 183 and the pressing roller 184.

The pressing roller 184 may be rotated by a rotating means (not shown) such as a motor under control of the hardware processor 10.

The fixing roller 183 and the pressing roller 184 nip a sheet of a recording medium at the fixing nip and heat and press the sheet while conveying it in the conveyance direction. The fixing roller 183 and the pressing roller 184 thus melt the toner on the sheet and thereby fix it. When in contact with the sheet, the temperature of the fixing roller 183 is controlled within the range of 180° C. to 200° C. Accordingly, the halogen lamp heaters heat the fixing roller 183 so that the temperature of the fixing roller 183 falls within the range.

As illustrated in FIG. 1, the conveyer 19, which includes sheet conveyance rollers that nip and convey a sheet by rotation, conveys the sheet in a predetermined conveyance route. The conveyer 19 includes a flipping mechanism 191 that flips the sheet on which the image fixing device 18 has performed the fixation and conveys it to the secondary transfer roller 175. In the image forming apparatus 1, when images are formed on both sides of a sheet, the flipping mechanism 191 flips over the sheet and the images are formed on the both sides, and the sheet is then ejected to a sheet tray 23. When an image is formed only on one side of a sheet, the sheet on which the image has been formed on one side is ejected to the sheet tray 23 without being flipped by the flipping mechanism 191.

The cleaning device 20 includes a rigid blade of a non-elastic material such as metal that abuts the intermediate transfer belt 174. By using the rigid blade, the cleaning device 20 removes foreign matter such as toner attached to the surface of the intermediate transfer belt 174.

Figure 3:
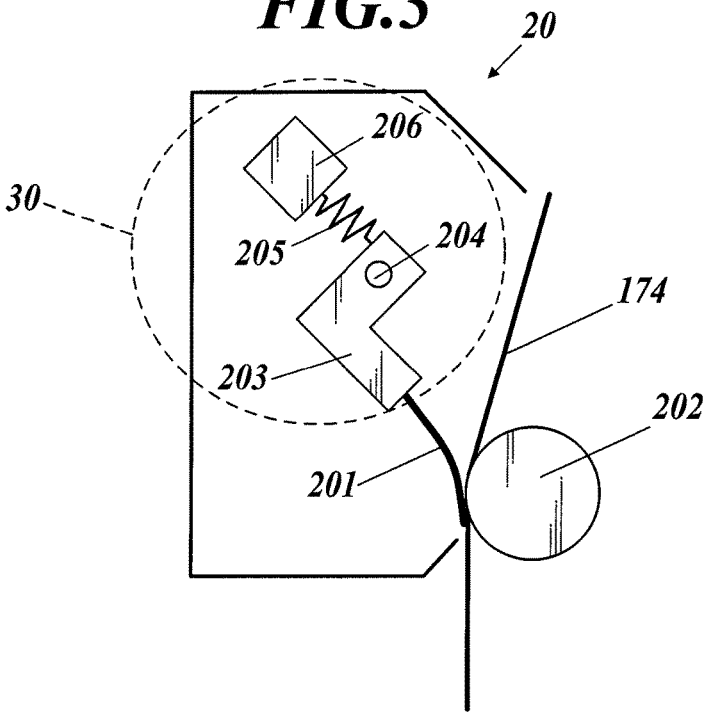
FIG. 3 is a schematic view of the configuration of the cleaning device.

FIG. 3 is a schematic view of the configuration of the cleaning device 20. The cleaning device 20 includes the rigid blade 201 as a cleaner, a counter roller 202, a blade holder 203, a rotation pivot 204, a biasing spring 205, a driver 206 such as an actuator, and the like.

One end of the rigid blade 201 abuts the intermediate transfer belt 174 at a predetermined abutting angle. The counter roller 202 is disposed on the back side of the intermediate transfer belt 174 at the abutting part between the rigid blade 201 and the intermediate transfer belt 174 so that the intermediate transfer belt 174 is nipped between the rigid blade 201 and the counter roller 202. It is preferred that the abutting portion of the rigid blade 201 is made of a metal material.

The other end of the rigid blade 201 is held by the blade holder 203. The blade holder 203 is disposed in the cleaning device 20 pivotably around the rotation pivot 204. Further, one end of the biasing spring 205 is held at the other side of the blade holder 203 where the other end of the rigid blade 201 is not held, and the other end of the biasing spring 205 is connected to the driver 206.

The blade holder 203, the rotation pivot 204, the biasing spring 205 and the driver 206 constitute an abutting angle adjuster 30.

In the abutting angle adjuster 30, the hardware processor 10 controls the driver 206 to adjust the pressing force applied to the biasing spring 205, which changes the biasing force applied to the blade holder 203, and the rotation angle of the blade holder 203 is changed accordingly. As a result, the abutting angle of the rigid blade 201 held by the blade holder 203 is also changed. In this way, it is possible to adjust the abutting angle with the intermediate transfer belt 174.

The environment detector 21 detects the environment inside the image forming apparatus 1. For example, the environment detector 21, which is constituted by a temperature sensor, a humidity sensor and the like, detects the temperature and the humidity inside the image forming apparatus 1 and outputs them to the hardware processor 10.

2. Description of Operation of Image Forming Apparatus

Hereinafter, the operation of the image forming apparatus 1 will be described with the flowchart of FIG. 4.

As illustrated in FIG. 4, the hardware processor 10 makes a determination as to whether a predetermined period of time is elapsed since the last image forming operation ends (Step S41). If it is determined that the predetermined period of time is not elapsed yet (Step S41, No), the hardware processor 10 resets a counter (Step S42). If it is determined that the predetermined period of time is elapsed (Step S41, Yes), the process proceeds to Step S45.

Then, the hardware processor 10 makes a determination as to whether to control the abutting angle based on the counter value of the counter (Step S43). For example, based on to the counter value, the hardware processor 10 determines it is time to control the abutting angle when several minutes to one hour has elapsed since the last image forming operation.

If it is determined not to control the abutting angle (Step S43, No), the hardware processor 10 increments the counter (Step S44), and the process returns to Step S43. If it is determined to control the abutting angle (Step S43, Yes), the process proceeds to Step S45.

Then, the hardware processor 10 resets the counter (Step S45), retrieves the environmental conditions detected by the environment detector 21 such as the temperature and the humidity (Step S46) and calculates the abutting angle that is suitable for the detected environment (Step S47).

The hardware processor 10 makes a determination as to whether the current abutting angle is equal to the calculated abutting angle (Step S48). If it is determined that the current abutting angle is equal to the calculated abutting angle (Step S48, Yes), the process proceeds to Step S51.

If it is determined that the current abutting angle is not equal to the calculated abutting angle (Step S48, No), the hardware processor 10 reads out a control value for the calculated abutting angle (Step S49) and adjusts the biasing force based on the control value so as to control the abutting angle (Step S50). Such control values, which are determined in an experiment or the like by figuring out the relationship between the biasing force and the abutting angle with respect to each environmental condition, are stored in the storage 11 beforehand.

Figure 5A:
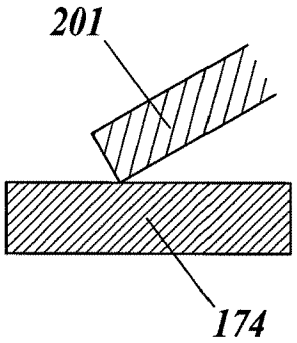
FIG. 5A to FIG. 5D are explanatory views of examples of the abutting angle of a cleaner.
Figure 5B:
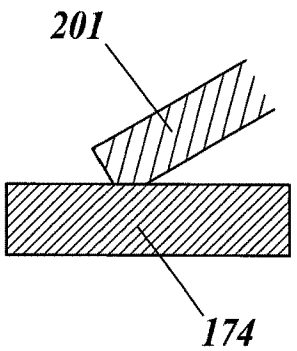

For example, suppose that the apparatus has operated for a long time in a high-temperature high-humidity environment as illustrated in FIG. 5A so that the rigid blade 201 is worn out as illustrated in FIG. 5B. In this condition, when the environmental condition changes from a high-temperature high-humidity environment to a low-temperature low-humidity environment, the frictional force against the intermediate transfer belt 174 decreases. Accordingly, the rigid blade 201 returns in the direction opposite the rotational direction of the intermediate transfer belt to balance the decreased frictional force, and thus moves or deforms in the direction of decreasing the abutting angle as illustrated in FIG. 5C.

Figure 5C:
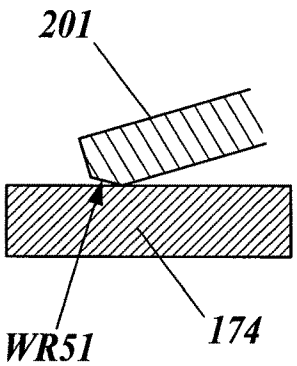
Figure 5D:
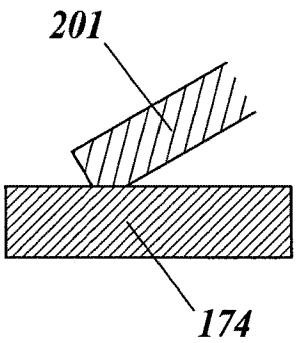

In this case, the wearing surface WR51 is lifted up to cause edge separation as illustrated in FIG. 5C. To avoid the occurrence of edge separation, the hardware processor 10 controls the abutting angle adjuster 30 to increase the abutting angle of the rigid blade 201 as illustrated in FIG. 5D. That is, the hardware processor 10 controls the abutting angle adjuster 30 to adjust the abutting angle of the rigid blade 201 to a predetermined angle. In other words, the abutting angle of the rigid blade 201 is maintained at the same angle as the abutting angle in a high-temperature high-humidity environment. As a result, the wearing surface WR51 is not lifted up, and the occurrence of edge separation can thus be avoided.

Figures 6, 7:
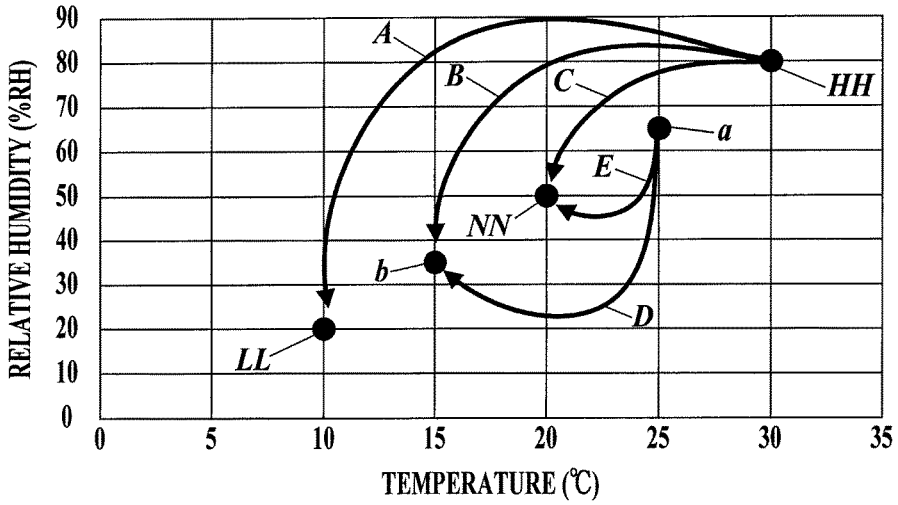
FIG. 6 is an explanatory view of different changes of the environmental condition.
FIG. 7 is an explanatory view of an example and a comparison in changes of the environmental condition.

FIG. 6 is an explanatory view of various changes of the environmental condition, and FIG. 7 is an explanatory view of an example and a comparison in the changes of the environmental condition. The abutting angle is controlled as described above in Example 1 but not in Comparison 1.

In FIG. 6 and FIG. 7, the symbol A represents whether an image noise due to imperfect cleaning occurs when image formation is performed on 10000 sheets in a high-temperature high-humidity environment (HH) and thereafter the environmental condition is changed to a low-temperature low-humidity environment (LL). The symbol "o" represents that an image noise did not occur, and the symbol "x" represents that an image noise occurred.

Similarly, the symbol B represents whether an image noise occurs when image formation is performed on 10000 sheets in a high-temperature high-humidity environment (HH) and thereafter the environmental condition is changed to an intermediate environment between a normal-temperature normal-humidity environment (NN) and a low-temperature low-humidity environment (LL). The symbol C represents whether an image noise occurs in the same case except that the environmental condition is changed to a normal-temperature normal-humidity environment (NN).

The symbol D represents whether an image noise occurs when image formation is performed on 10000 sheets in an environment between a high-temperature high-humidity environment (HH) and a normal-temperature normal-humidity environment (NN) and thereafter the environmental condition is changed to an intermediate environment between a normal-temperature normal-humidity environment (NN) and a low-temperature low-humidity environment (LL). The symbol E represents whether an image noise occurs in the same case except that the environmental condition is changed to a normal-temperature normal-humidity environment (NN).

As in Comparison 1 in FIG. 7, edge separation and a resultant image noise occurred without a control of the abutting angle when image formation was performed on 10000 sheets in a high-temperature high-humidity environment (HH) and thereafter the environmental condition was changed. In contrast, as in Example 1, the control of the abutting angle successfully prevented edge separation and therefore maintained the cleaning performance.

Finally, the hardware processor 10 makes a determination as to whether the image forming operation is completed (Step S51). If it is determined that the image forming operation is not completed yet (Step S51, No), the process returns to Step S43. If it is determined that the image forming operation is completed (Step S51, Yes), the process ends.

As described above, the image forming apparatus 1 includes the abutting angle adjuster 30 that adjusts the abutting angle between the rigid blade 201 and the intermediate transfer belt 174, and the hardware processor 10 controls the abutting angle adjuster 30 to maintain the abutting angle at the predetermined angle. In this way, it is possible to prevent edge separation and to maintain the cleaning performance.

3. Description of Configuration of Intermediate Transfer Belt 174

Figures 8, 9:
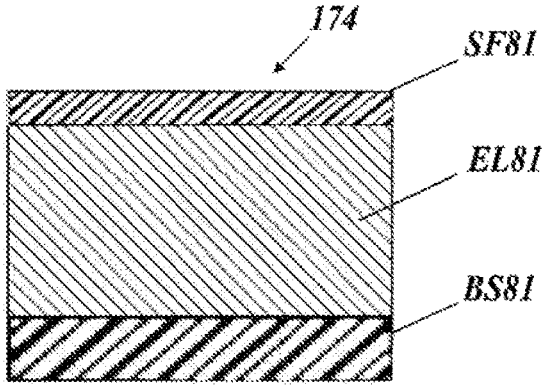
FIG. 8 is an explanatory view illustrating a cross section of an example of an intermediate transfer belt.
FIG. 9 is an explanatory view of another example and another comparison in changes of the environmental condition.

FIG. 8 is an explanatory view illustrating a cross section of an example of the intermediate transfer belt 174. As illustrated in FIG. 8, an elastically deformable elastic layer EL81 is formed between a base layer BS81 and a surface layer SF81. When the intermediate transfer belt 174 has the configuration as illustrated in FIG. 8, the friction between the rigid blade 201 and the intermediate transfer belt 174 increases due to the elastic layer EL81, and the rigid blade 201 is likely to be worn out more rapidly.

FIG. 9 is an explanatory view of an example and a comparison in changes of the environmental condition in the case in which the intermediate transfer belt 174 has the elastic layer EL81. The symbols A to E in the figure represent the same cases as those in FIG. 7.

No image noise occurred in Comparison 1 in the cases of symbols D and E in FIG. 7. However, as in Comparison 2 in FIG. 9, when the intermediate transfer belt 174 had the elastic layer EL81, an image noise occurred in all cases. In contrast, no image noise occurred in Example 2.

As described above, even when the intermediate transfer belt 174 has the elastic layer EL81, the control of the abutting angle successfully prevented edge separation and maintained the cleaning performance.

4. Variations of Abutting Angle Adjuster Variation 1

In the above-described embodiment, the abutting angle adjuster 30 adjusts the abutting angle of the rigid blade 201 with respect to the intermediate transfer belt 174 by adjusting the biasing force by means of the driver 206. Instead, the abutting angle may be controlled by directly applying a pressing force to the rigid blade 201 by means of a cam that presses the rigid blade 201.

Figure 10:
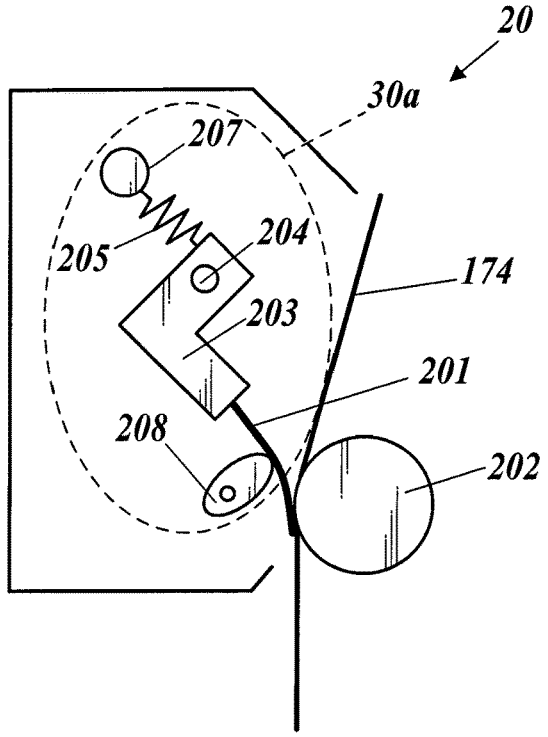
FIG. 10 is a schematic view of the configuration of Variation 1.

FIG. 10 is a schematic view of an example of the configuration of cleaning device 20 in which a cam is used as an abutting angle changer. In FIG. 10, an abutting angle adjuster 30*a* is constituted by a blade holder 203, a rotation pivot 204, a biasing spring 205, a fixing member 207 and the cam 208. The driver 206 is removed, and one end of the biasing spring 205, which is connected to the driver 206 in the previously-described embodiment, is fixed at the fixing member 207. The cam 208 is positioned to directly press the rigid blade 201.

In the abutting angle adjuster 30*a*, the cam 208 rotates about an axis by means of a driver (not shown) under control of the hardware processor 10. The cam 208 directly presses the rigid blade 201, and the cam 208 rotating about the axis changes the pressing force applied to the rigid blade 201. In this way, it is possible to adjust the abutting angle of the rigid blade 201 against the intermediate transfer belt 174.

Variation 2

In the above-described embodiment, the abutting angle adjuster 30 adjusts the abutting angle of the rigid blade 201 with respect to the intermediate transfer belt 174 by adjusting the biasing force by means of the driver 206. Instead, the abutting angle may be adjusted by changing the biasing force applied to the blade holder 203 holding the rigid blade 201 by means of a magnet.

Figure 11:
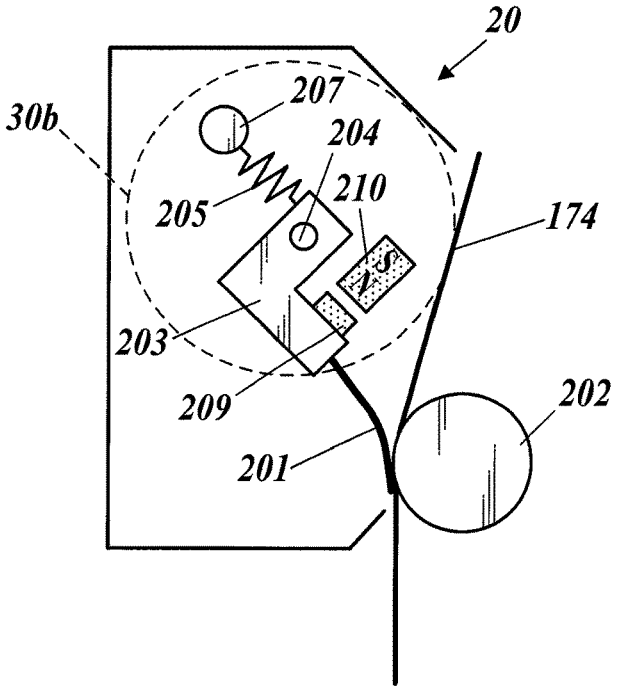
FIG. 11 is a schematic view of the configuration of Variation 2.

FIG. 11 is a schematic view of an example of the configuration of the cleaning device 20 in which a magnet is used as an abutting angle changer. In FIG. 11, an abutting angle adjuster 30*b* is constituted by a blade holder 203, a rotation pivot 204, a biasing spring 205, a fixing member 207 a magnetic body 209 and a magnet 210.

In the abutting angle adjuster 30*b*, the magnetic body 209 is disposed in the blade holder 203, and the magnet 210 is disposed in the vicinity of the magnetic body 209. The magnet 210 is moved in the direction toward or away from the magnetic body 209 by means of a driver (not shown) under control of the hardware processor 10.

By moving the magnet 210, the distance between the magnet 210 and the magnetic body 209 is changed, and the biasing force applied to the blade holder 203 of the rigid blade 201 is changed according to the magnetic force. In this way, it is possible to adjust the abutting angle.

Variation 3

In the above-described embodiment, the abutting angle adjuster 30 adjusts the abutting angle of the rigid blade 201 with respect to the intermediate transfer belt 174 by adjusting the biasing force by means of the driver 206. Instead, the abutting angle may be adjusted by changing the trajectory of the intermediate transfer belt 174.

Figure 12:
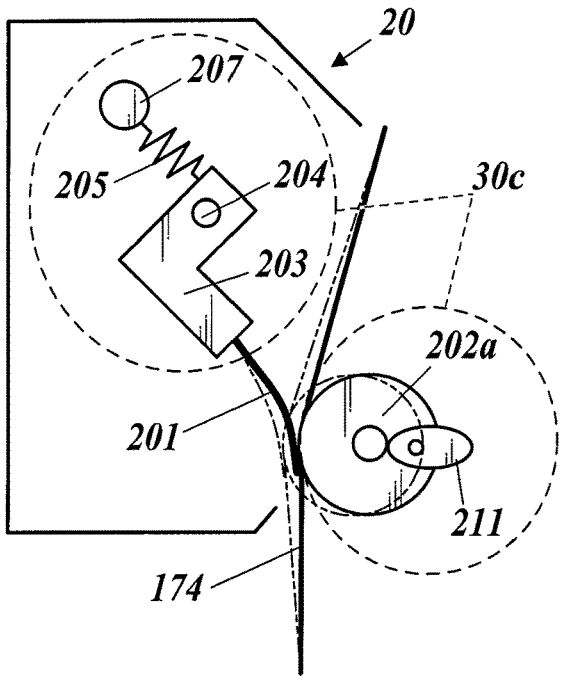
FIG. 12 is a schematic view of the configuration of Variation 3.

FIG. 12 is a schematic view of an example of the configuration of the cleaning device 20 which changes the trajectory of the intermediate transfer belt 174 as an abutting angle changer. As illustrated in FIG. 12, the abutting angle adjuster 30*c* is constituted by a blade holder 203, a rotation pivot 204, a biasing spring 205, a fixing member 207, a counter roller 202*a* and a cam 211.

In the abutting angle adjuster 30*c*, the cam 211 is disposed in the vicinity of the rotation axis of the counter roller 202*a*. Further, the cam 211 rotates about an axis by means of a driver (not shown) under control of the hardware processor 10. That is, the rotating cam 211 presses the rotation axis of the counter roller 202*a* so as to change the position of the counter roller 202*a*.

The cam 211 changes the position of the counter roller 202*a* and thereby changes the trajectory of the intermediate transfer belt 174. In this way, it is possible to adjust the abutting angle.

Variation 4

In Variation 3, the mechanism that changes the position of the counter roller 202*a* by using the cam 211 is provided to control the abutting angle of the rigid blade 201 with respect to the intermediate transfer belt 174. Instead of the counter roller, a guide roller may be provided in the downstream, and the abutting angle may be controlled by changing the trajectory of the intermediate transfer belt 174 by means of the guide roller.

Figure 13:
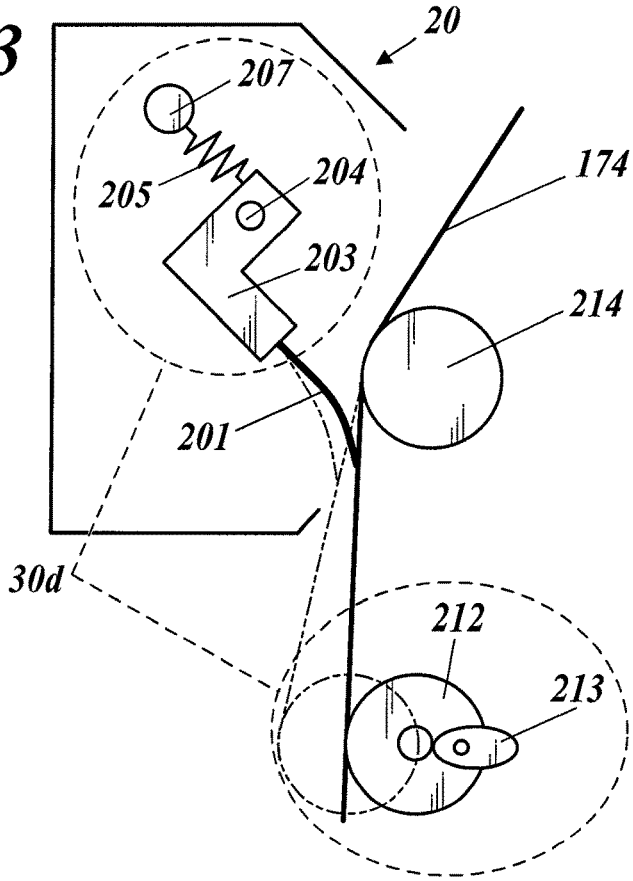
FIG. 13 is a schematic view of the configuration of Variation 4.

FIG. 13 is a schematic view of an example of the configuration of the cleaning device 20 which changes the trajectory of the intermediate transfer belt 174 by using a guide roller as an abutting angle changer. As illustrated in FIG. 13, the abutting angle adjuster 30*d* is constituted by a blade holder 203, a rotation pivot 204, a biasing spring 205, a fixing member 207, guide rollers 212, 214 and a cam 213.

In the abutting angle adjuster 30*d*, the counter roller 202*a* of Variation 3 is removed, and the two guide rollers 212, 214 are provided to guide the intermediate transfer belt 174.

The cam 213 is provided in the vicinity of the rotation axis of the downstream guide roller 212. The cam 213 rotates around the axis by means of a driver (not shown) under control of the hardware processor 10. That is, the rotating cam 213 presses the rotation axis of the downstream guide roller 212 so as to change the position of the guide roller 212.

The cam 213 changes the position of the downstream guide roller 212 and thereby changes the trajectory of the intermediate transfer belt 174. In this way, it is possible to adjust the abutting angle.

In the embodiment, the image fixing device 18 includes the fixing roller 183 and the pressing roller 184, which constitute a nip portion that nips and conveys the sheet. However, the image fixing device 18 may further include a heating roller as a heating member and a fixing belt, in which the fixing belt is supported and stretched between the heating roller and the fixing roller 183, and the fixing roller 183 and the pressing roller 184 together with the fixing belt intervened therebetween constitute the nip portion that nips and convey the sheet.

The embodiment illustrates an example in which the image forming apparatus 1 includes image forming units respectively for the colors of Y (yellow), M (magenta), C (cyan) and K (black), and an color image is formed on the sheet. However, this configuration is merely an example, and the image forming apparatus may be configured to form a monochromatic image.

In the embodiment, the fixing roller and the pressing roller are distinguished from each other. However, they can be considered as a pair of fixing members.

The embodiment illustrates an example in which a sheet is used as a recording medium. However, the recording medium is not limited to paper, and may be constituted by any sheet material on which a toner image can be formed and fixed. For example, such materials include non-woven, plastic film, leather and the like.

This U.S. patent application claims priority to Japanese patent application No. 2016-035278 filed on Feb. 26, 2016, the entire contents of which are incorporated by reference herein for correction of incorrect translation.

What is claimed is:

1. An image forming apparatus, comprising:

an image carrier;

a latent image forming device which forms a latent image on the image carrier;

a developer which develops the latent image on the image carrier by using a developing agent containing at least a toner;

an intermediate transfer belt which supports and carries a toner image which is transferred from the image carrier by primary transfer;

a second transfer device which performs secondary transfer to transfer the toner image transferred on the intermediate transfer belt to a recording medium;

a cleaner which abuts the intermediate transfer belt to remove toner attached to a surface of the intermediate transfer belt and which comprises an abutting portion that is less elastically deformable than rubber;

an abutting angle adjuster which adjusts an abutting angle between the cleaner and the intermediate transfer belt;

an environment detector which detects a usage environment of the image forming apparatus; and a hardware processor which controls the abutting angle adjuster to maintain the abutting angle at a predetermined angle, wherein the hardware processor: (i) calculates an angle suitable for the usage environment based on a detection result of the environment detector, (ii) makes a determination as to whether the calculated angle is equal to the predetermined angle, and (iii) controls the abutting angle adjuster, based on the determination, to adjust the abutting angle to maintain the predetermined angle.

2. The image forming apparatus according to claim 1, wherein the abutting portion of the cleaner is made of a metal material.

3. The image forming apparatus according to claim 1, wherein the intermediate transfer belt is constituted by two or more layers at least one of which is made of an elastically deformable material.

4. The image forming apparatus according to claim 1, wherein the abutting angle adjuster changes a pressing force applied to the cleaner by means of a cam.

5. The image forming apparatus according to claim 1, wherein the abutting angle adjuster changes a biasing force applied to a blade holder of the cleaner by means of a driver or a magnetic force.

6. The image forming apparatus according to claim 1, wherein the abutting angle adjuster changes a position of a counter roller or a guide roller provided on a back side of the intermediate transfer belt by means of a cam so as to change a trajectory of the intermediate transfer belt at an abutting portion between the cleaner and the intermediate transfer belt.

7. An image forming method performed in an image forming apparatus, said image forming method comprising the steps of:

forming a latent image on an image carrier;

developing the latent image to form a toner image on the image carrier by using a developing agent containing at least a toner;

primarily transferring the toner image from the image carrier to an intermediate transfer belt;

secondary transferring the toner image from the intermediate transfer belt to a recording medium;

removing toner attached to a surface of the intermediate transfer belt by using a cleaner having an abutting portion that is less elastically deformable than rubber;

adjusting an abutting angle between the cleaner and the intermediate transfer belt;

detecting a usage environment of the image forming apparatus; and controlling the abutting angle of the cleaner to maintain the abutting angle at a predetermined angle, wherein the controlling of the abutting angle includes: (i) calculating an angle suitable for the usage environment based on a detection result, (ii) making a determination as to whether the calculated angle is equal to the predetermined angle, and (iii) controlling the adjusting of the abutting angle, based on the determination, to adjust the abutting angle to maintain the predetermined angle.

8. The image forming method according to claim 7, wherein the abutting portion of the cleaner is made of a metal material.

9. The image forming method according to claim 7, wherein the intermediate transfer belt is constituted by two or more layers at least one of which is made of an elastically deformable material.

10. The image forming method according to claim 7, wherein the adjusting of the abutting angle is performed by changing a pressing force applied to the cleaner by means of a cam.

11. The image forming method according to claim 7, wherein the adjusting of the abutting angle is performed by changing a biasing force applied to a blade holder of the cleaner by means of a driver or a magnetic force.

12. The image forming method according to claim 7, wherein the adjusting of the abutting angle is performed by changing a position of a counter roller or a guide roller provided on a back side of the intermediate transfer belt by means of a cam so as to change a trajectory of the intermediate transfer belt at an abutting portion between the cleaner and the intermediate transfer belt.

* * * * *